US010099879B1

(12) United States Patent
Tsai et al.

(10) Patent No.: US 10,099,879 B1
(45) Date of Patent: Oct. 16, 2018

(54) PAPER FEEDING DEVICE

(71) Applicant: Foxlink Image Technology Co., Ltd., New Taipei (TW)

(72) Inventors: Wei Xiang Tsai, New Taipei (TW); Min Hsiung Lin, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 15/957,925

(22) Filed: Apr. 20, 2018

(30) Foreign Application Priority Data

Oct. 19, 2017 (TW) ..... 106215387 U

(51) Int. Cl.

| | |
|---|---|
| ***B65H 5/00*** | (2006.01) |
| ***B65H 7/18*** | (2006.01) |
| ***B65H 3/06*** | (2006.01) |
| ***B65H 5/06*** | (2006.01) |
| ***B65H 1/26*** | (2006.01) |

(52) U.S. Cl.
CPC ..... *B65H 7/18* (2013.01); *B65H 1/266* (2013.01); *B65H 3/0607* (2013.01); *B65H 3/0676* (2013.01); *B65H 5/06* (2013.01); *B65H 3/0623* (2013.01); *B65H 2403/80* (2013.01)

(58) Field of Classification Search
CPC ..... B65H 3/0623; B65H 3/0607; B65H 3/06; B65H 2403/80
See application file for complete search history.

(56) References Cited

U.S. PATENT DOCUMENTS

| | | | | |
|---|---|---|---|---|
| 7,392,980 | B2 * | 7/2008 | Takeuchi | B65H 3/5261 271/10.01 |
| 2005/0073088 | A1 * | 4/2005 | Watase | B65H 3/0615 271/121 |
| 2008/0290584 | A1 * | 11/2008 | Dunn | B65H 5/062 271/10.02 |

* cited by examiner

*Primary Examiner* — Howard J Sanders
(74) *Attorney, Agent, or Firm* — Lin & Associates IP, Inc.

(57) ABSTRACT

A paper feeding device includes a first transmission module mounted in a transaction device, a pickup shaft, at least one pickup roller and at least one separation roller. The pickup shaft is rotatably and pivotally connected to the transaction device. The pickup shaft is connected with the first transmission module, and the first transmission module is capable of driving the pickup shaft to rotate towards a clockwise direction or an anticlockwise direction. The at least one pickup roller is fastened around the pickup shaft. The at least one separation roller is rotatably and pivotally connected to the transaction device. An outer surface of the at least one separation roller oppositely abuts against an outer surface of the at least one pickup roller.

16 Claims, 10 Drawing Sheets

PAPER FEEDING DEVICE

CROSS-REFERENCE TO RELATED APPLICATION

The present application is based on, and claims priority form, Taiwan Patent Application No. 106215387, filed Oct. 19, 2017, the disclosure of which is hereby incorporated by reference herein in its entirety.

BACKGROUND OF THE INVENTION

1. Field of the Invention

The present invention generally relates to a paper feeding device, and more particularly to a paper feeding device capable of effectively preventing more than one piece of paper from being fed in and a damage of the paper.

2. The Related Art

Referring to FIG. 8 and FIG. 9, a conventional paper feeding device 100' includes a transmission module (not shown), a pickup roller assembly 10', a direction limiter (not shown) and a separation roller assembly 20'. The pickup roller assembly 10' includes a pickup shaft 11', and a pickup roller 12' fastened around the pickup shaft 11'. The pickup shaft 11' is connected with the transmission module. The transmission module drives the pickup shaft 11' to rotate clockwise or anticlockwise. The direction limiter is fastened to the pickup shaft 11' for limiting a rotation direction of the pickup shaft 11', so that the pickup shaft 11' can just rotate towards clockwise or anticlockwise. The transmission module of the conventional paper feeding device 100' can just drive the pickup shaft 11' to rotate anticlockwise, when the transmission module drives the pickup shaft 11' to rotate clockwise, the direction limiter will limit the pickup shaft 11' to make the pickup shaft 11' be incapable of rotating.

The separation roller assembly 20' includes a separation roller 21'. An outer surface of the separation roller 21' oppositely abuts against an outer surface of the pickup roller 12'. When the transmission module drives the pickup shaft 11' and the pickup roller 12' to rotate anticlockwise and drives the paper 200' to be fed in, the separation roller 21' will be driven to rotate clockwise, so that the fed paper 200' proceed being separated from the other paper 200' and the separated paper 200' continues being fed forward.

Referring to FIG. 10, in the process of the pickup roller 12' feeding the paper 200', rotation speeds of the transmission module driving the pickup shaft 11' will be changed according to different processes of the paper 200' being fed in. A separation area 22' of the separation roller 21' is an area of the outer surface of the separation roller 21' abutting against the outer surface of the pickup roller 12'.

However, after a first paper P1 starts being fed in, a second paper P2 next to the first paper P1 and subsequent paper 200' are easily stacked on a feeding end of a separation area 22' of the separation roller 21' on account of the second paper P2 and the subsequent paper 200' being driven by the first paper P1. Furthermore, in processes of picking up and feeding the paper 200' repeatedly, the second paper P2 next to the first paper P1 and the subsequent paper 200' will be slowly carried forward on account of an acceleration and a deceleration of the pickup roller 12' or a momentary speed variation of the paper 200' at the time of the paper 200' being fed in, so that the second paper P2 next to the first paper P1 and the subsequent paper 200' enter the area of the outer surface of the separation roller 21' abutting against the outer surface of the pickup roller 12', namely the separation area 22' of the separation roller 21', at last, more than one piece of paper 200' being fed in and a damage of the paper 200' at the time of the paper 200' being fed in are caused.

Thus, in order to solve the above-mentioned problems, an innovative paper feeding device is essential to be provided and capable of effectively preventing more than one piece of paper from being fed in and a damage of the paper.

SUMMARY OF THE INVENTION

An object of the present invention is to provide a paper feeding device mounted in a transaction device for transmitting paper. The paper feeding device includes a first transmission module mounted in the transaction device, a pickup shaft, at least one pickup roller and at least one separation roller. The pickup shaft is rotatably and pivotally connected to the transaction device. The pickup shaft is connected with the first transmission module, and the first transmission module is capable of driving the pickup shaft to rotate towards a clockwise direction or an anticlockwise direction. The at least one pickup roller is fastened around the pickup shaft. The at least one separation roller is rotatably and pivotally connected to the transaction device. An outer surface of the at least one separation roller oppositely abuts against an outer surface of the at least one pickup roller. The first transmission module drives the pickup shaft and the at least one pickup roller to rotate towards the anticlockwise direction to pick up the paper and feed forward the paper. The paper includes a first paper, and a second paper adhered to a top surface of the first paper. When the at least one pickup roller rotates towards the anticlockwise direction and drives the at least one separation roller to rotate towards the clockwise direction, the at least one pickup roller cooperates with the at least one separation roller to separate the first paper from the second paper and drive the first paper to be continued being fed forward. When a tail end of the first paper leaves the at least one pickup roller and the at least one separation roller, the first transmission module drives the at least one pickup roller to rotate towards the clockwise direction at a preset time, and simultaneously the at least one pickup roller drives the at least one separation roller to rotate towards the anticlockwise direction at the preset time, so that the second paper brought in at the time of the first paper being fed in is withdrawn until the second paper is withdrawn from an area of the outer surface of the at least one pickup roller abutting against the outer surface of the at least one separation roller.

As described above, the first transmission module of the paper feeding device is capable of driving the at least one pickup roller to rotate towards the clockwise direction or the anticlockwise direction by virtue of a direction limiter being without being disposed to the pickup shaft, before the at least one pickup roller rotates towards the anticlockwise direction to proceed picking up the first paper every time, the at least one pickup roller is in need of rotating towards the clockwise direction at the preset time in advance, the second paper brought in at the time of the first paper being fed in is withdrawn until the second paper is withdrawn from the area of the outer surface of the at least one pickup roller abutting against the outer surface of the at least one separation roller, so that the paper feeding device effectively prevents more than one piece of the paper from being fed in and a damage of the paper.

BRIEF DESCRIPTION OF THE DRAWING

The present invention will be apparent to those skilled in the art by reading the following description, with reference to the attached drawing, in which.

DETAILED DESCRIPTION OF THE PREFERRED EMBODIMENT

Figure 1:
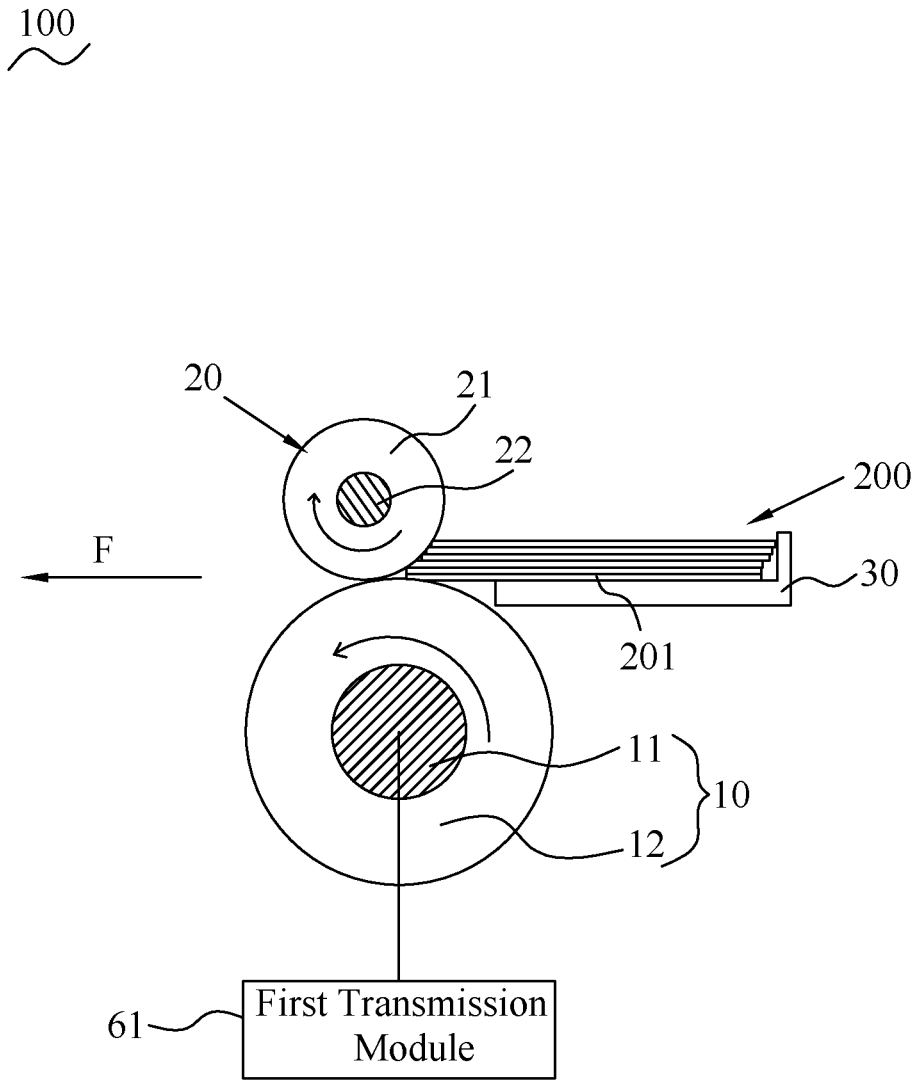
FIG. 1 is a diagrammatic drawing of a paper feeding device in accordance with a first preferred embodiment of the present invention.
Figure 6:
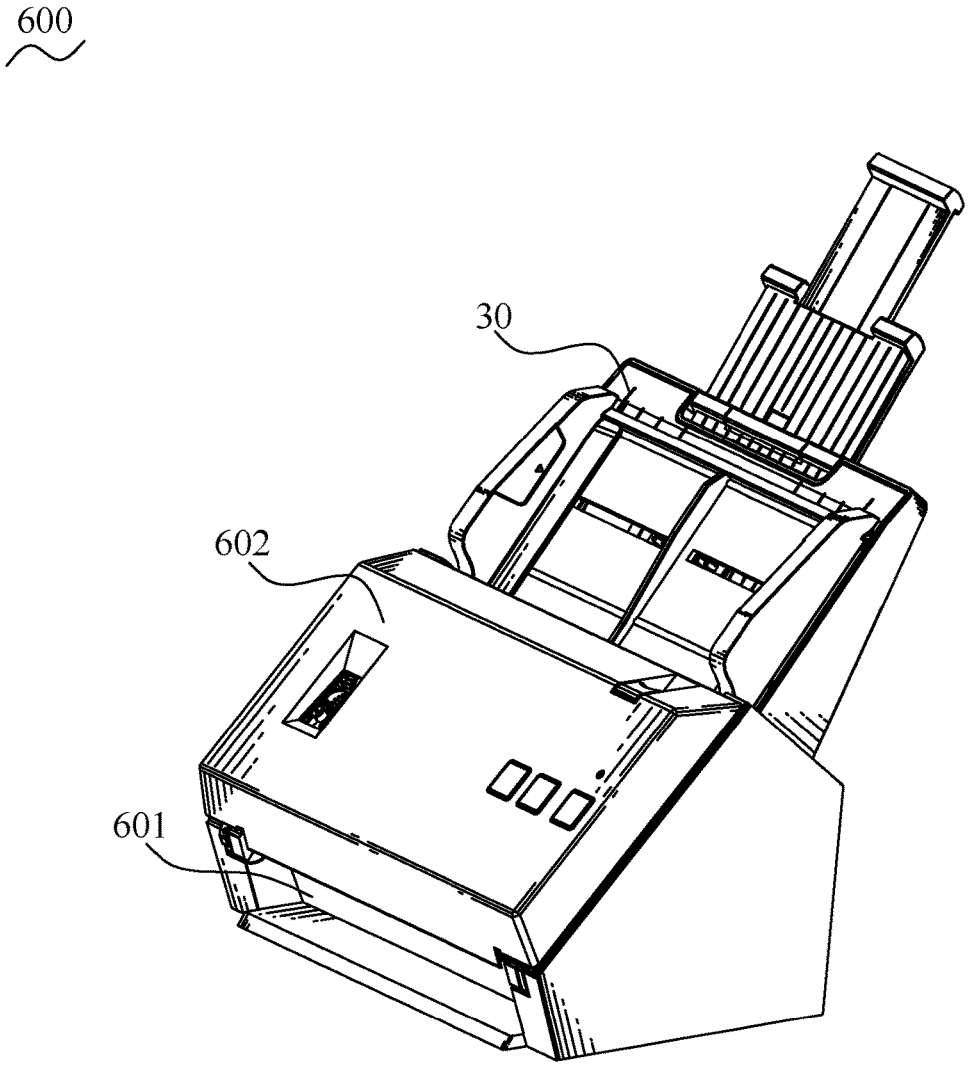
FIG. 6 is a diagrammatic drawing of a transaction device, wherein the paper feeding device is mounted in the transaction device.

With reference to FIG. 1 and FIG. 6, a paper feeding device 100 in accordance with a first preferred embodiment of the present invention is shown. The paper feeding device 100 is mounted in a transaction device 600 for transmitting paper 200. The paper feeding device 100 includes a first transmission module 61 mounted in the transaction device 600, a pickup roller assembly 10 and a separation roller assembly 20.

Figure 2:
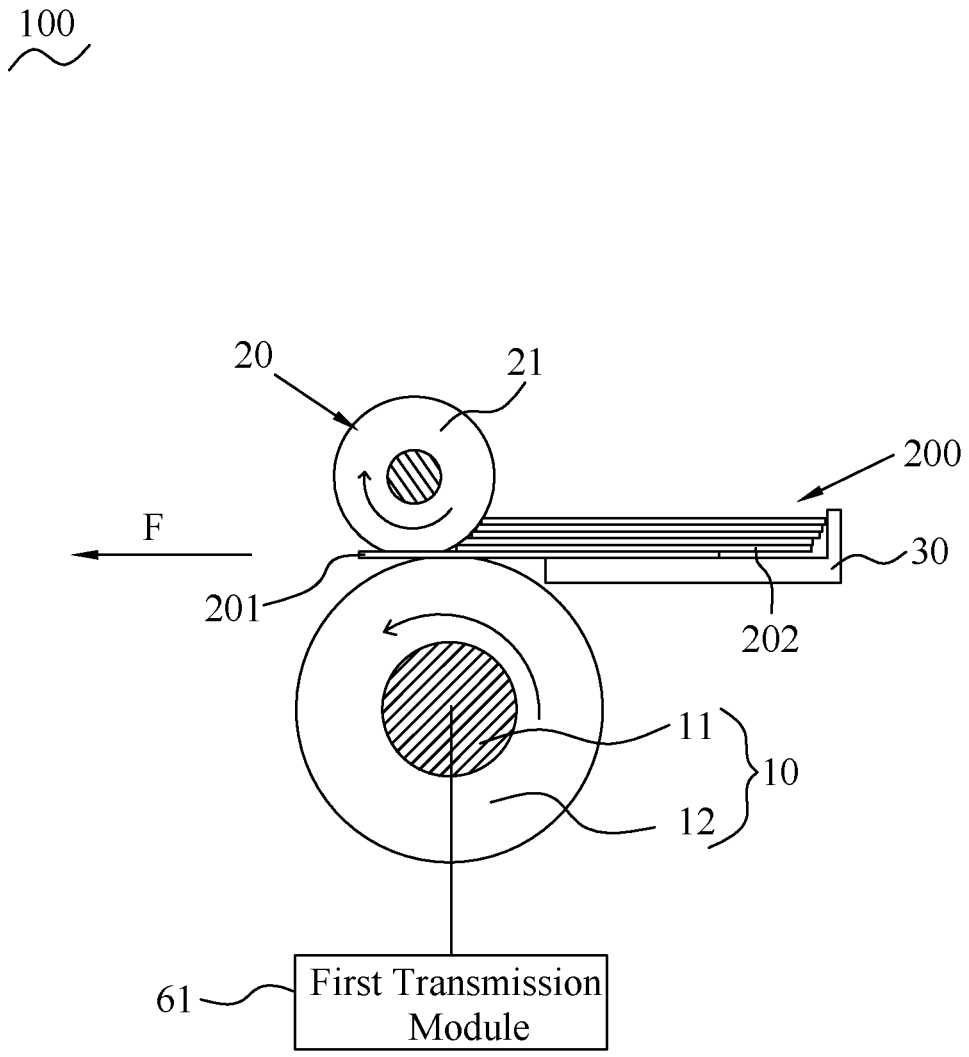
FIG. 2 is a diagrammatic drawing of the paper feeding device of FIG. 1, wherein paper is fed into the paper feeding device.
Figure 3:
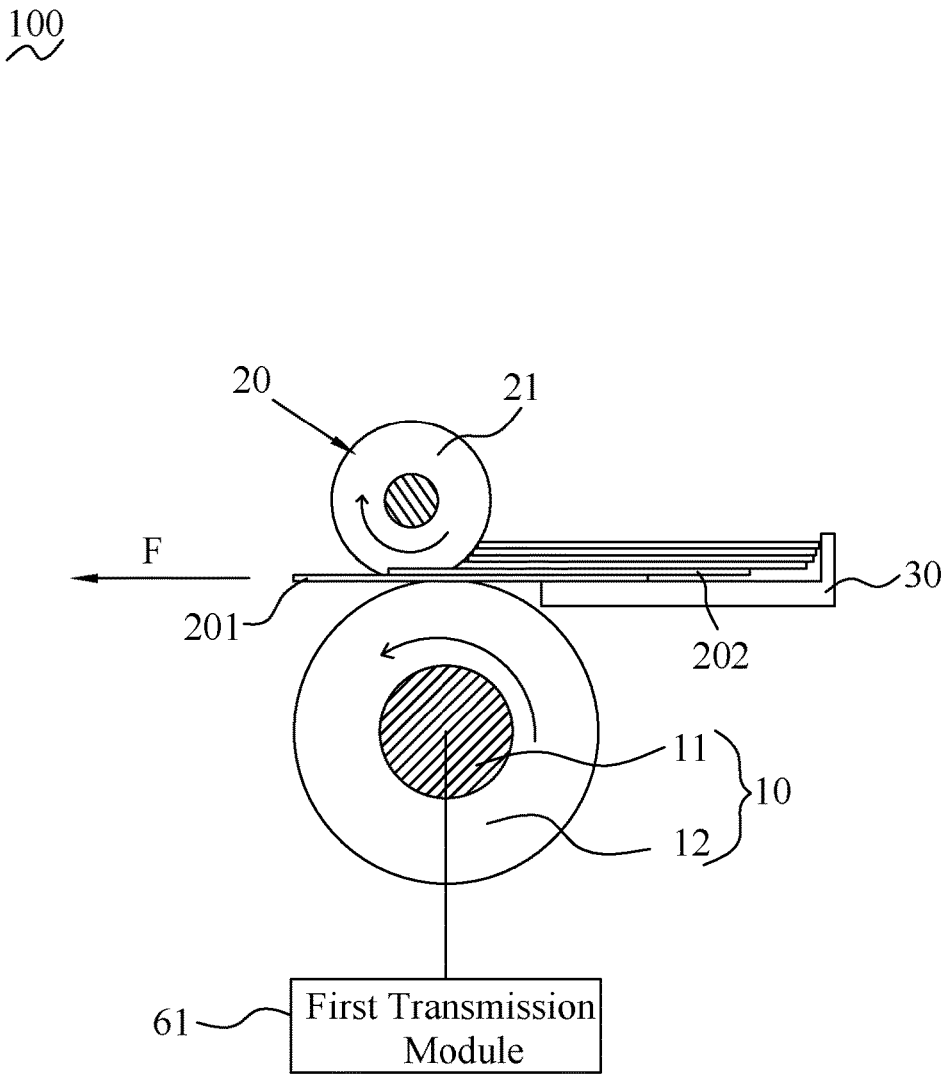
FIG. 3 is a diagrammatic drawing of the paper feeding device of FIG. 1, wherein when a first paper is fed in, a second paper is driven to be fed into an area where an outer surface of a pickup roller abuts against an outer surface of a separation roller.
Figure 4:
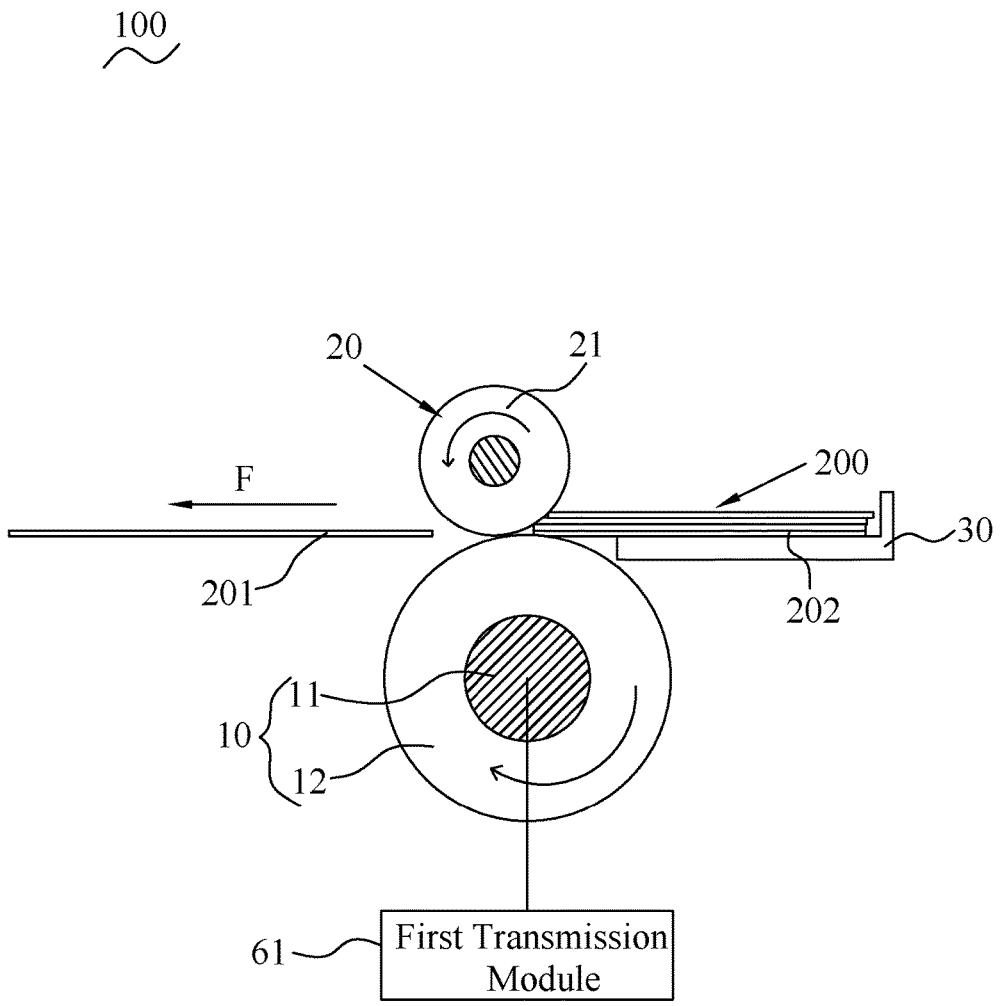
FIG. 4 is a diagrammatic drawing of the paper feeding device of FIG. 3, wherein a first transmission module drives the pickup roller to rotate clockwise after a tail end of the first paper leaves, the pickup roller drives the separation roller to rotate anticlockwise, so that the second paper which is fed in at the time of the first paper being fed in is withdrawn until the second paper is withdrawn from the area where the outer surface of the pickup roller abuts against the outer surface of the separation roller.

Referring to FIG. 1, FIG. 2 and FIG. 6, the transaction device 600 is a printer or a scanner etc. The transaction device 600 includes a main portion 601 and an upper cover 602 pivotally connected with and covered to the main portion 601. A paper feeding channel (not shown) is formed between the upper cover 602 and the main portion 601. The paper feeding device 100 is used for picking up the paper 200 which is to be scanned or printed and feeding the paper 200 to the paper feeding channel. The paper 200 includes a first paper 201, a second paper 202 adhered to a top surface of the first paper 201, and other paper 200 disposed to a top surface of the second paper 202.

Referring to FIG. 1, FIG. 2 and FIG. 6 again, the paper feeding device 100 further includes an input tray 30. The input tray 30 is fastened to one side of the main portion 601 and communicated with the paper feeding channel. The paper 200 which is to be scanned or printed are stacked in the input tray 30 along a top-to-bottom direction. The pickup roller assembly 10 includes a pickup shaft 11 and at least one pickup roller 12. The pickup shaft 11 is rotatably and pivotally connected to the main portion 601 of the transaction device 600. The at least one pickup roller 12 is fastened around the pickup shaft 11 and projects beyond a top surface of the main portion 601. A bottommost piece of the paper 200 located in the input tray 30 is defined as the first paper 201. A piece of paper located on the top surface of the first paper 201 is defined as the second paper 202. A feeding end of the first paper 201 abuts against an outer surface of the at least one pickup roller 12. The pickup shaft 11 is connected with the first transmission module 61, and the first transmission module 61 is capable of driving the pickup shaft 11 to rotate towards a clockwise direction or an anticlockwise direction.

Referring to FIG. 1 and FIG. 6, the separation roller assembly 20 is rotatably and pivotally connected to the upper cover 602 of the transaction device 600. The separation roller assembly 20 includes a separation shaft 22, and at least one separation roller 21. The separation shaft 22 is rotatably and pivotally connected to the transaction device 600. The at least one separation roller 21 is fastened around the separation shaft 22. The at least one separation roller 21 projects beyond a bottom surface of the upper cover 602. An outer surface of the at least one separation roller 21 oppositely abuts against the outer surface of the at least one pickup roller 12. When the first transmission module 61 drives the pickup shaft 11 and the at least one pickup roller 12 to rotate towards a rotation direction, the at least one separation roller 21 is driven to rotate towards a direction opposite to the rotation direction of the pickup shaft 11 and the at least one pickup roller 12. The rotation direction of the pickup shaft 11 and the at least one pickup roller 12 is the clockwise direction or the anticlockwise direction.

Referring to FIG. 1 to FIG. 7, a working process of the paper feeding device 100 is described as follows. At first, after a user gives an order of starting scanning or printing, the first transmission module 61 drives the pickup shaft 11 and the at least one pickup roller 12 to rotate towards the anticlockwise direction to pick up the first paper 201 and feed forward the first paper 201. A direction of feeding forward the paper 200 is defined as a feeding direction F of the paper 200. When the at least one pickup roller 12 rotates towards the anticlockwise direction and drives the at least one separation roller 21 to rotate towards the clockwise direction, the clockwise direction is defined as a reverse direction, the at least one pickup roller 12 cooperates with the at least one separation roller 21 to separate the first paper 201 from the second paper 202 and the other paper 200 and drive the first paper 201 to be continued being fed forward. When a tail end of the first paper 201 leaves the at least one pickup roller 12 and the at least one separation roller 21, the first transmission module 61 drives the at least one pickup roller 12 to rotate towards the clockwise direction at a preset time, and simultaneously the at least one pickup roller 12 drives the at least one separation roller 21 to rotate towards the anticlockwise direction at the preset time, so that the second paper 202 and the other paper 200 brought in at the time of the first paper 201 being fed in is withdrawn until the second paper 202 and the other paper 200 are withdrawn from an area of the outer surface of the at least one pickup roller 12 abutting against the outer surface of the at least one separation roller 21.

Then the first transmission module 61 drives the at least one pickup roller 12 again to rotate towards the anticlockwise direction to proceed picking up the paper 200 for a second time, the at least one separation roller 21 will combine with the at least one pickup roller 12 to proceed a second-time paper separation action. Starting with the second paper 202, thereafter, before the at least one pickup roller 12 proceed picking up the paper 200 towards the anticlockwise direction every time, the at least one pickup roller 12 is in need of rotating towards the clockwise direction at a preset time in advance, the other paper 200 brought in at the time of a previous paper 200 being fed in is withdrawn until the other paper 200 is withdrawn from the area of the outer surface of the at least one pickup roller 12 abutting against the outer surface of the at least one separation roller 21, so that the paper feeding device 100 is capable of effectively preventing more than one piece of the paper 200 from being fed in and a damage of the paper 200.

Figure 7:
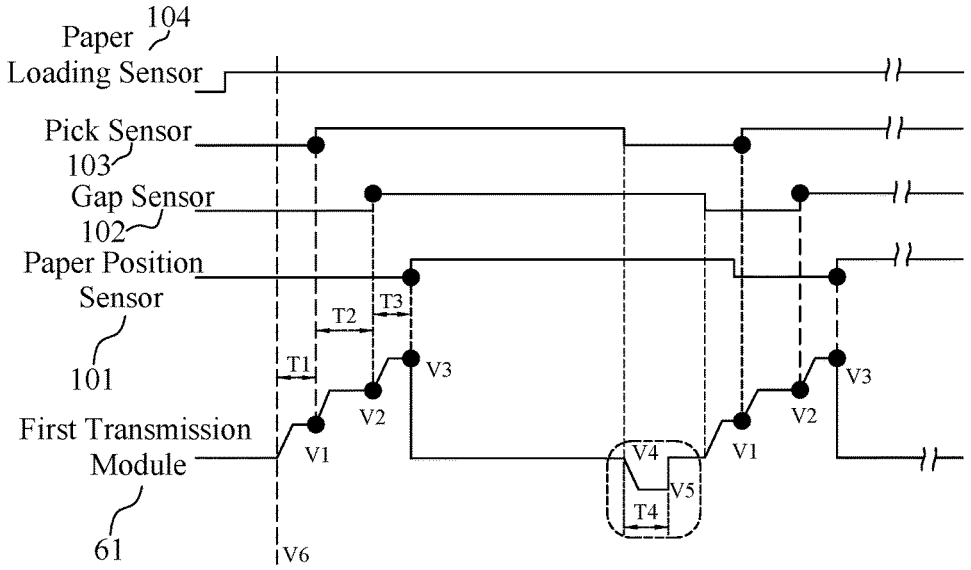
FIG. 7 is a sequence chart of the paper feeding device in accordance with the present invention.
Figure 8:
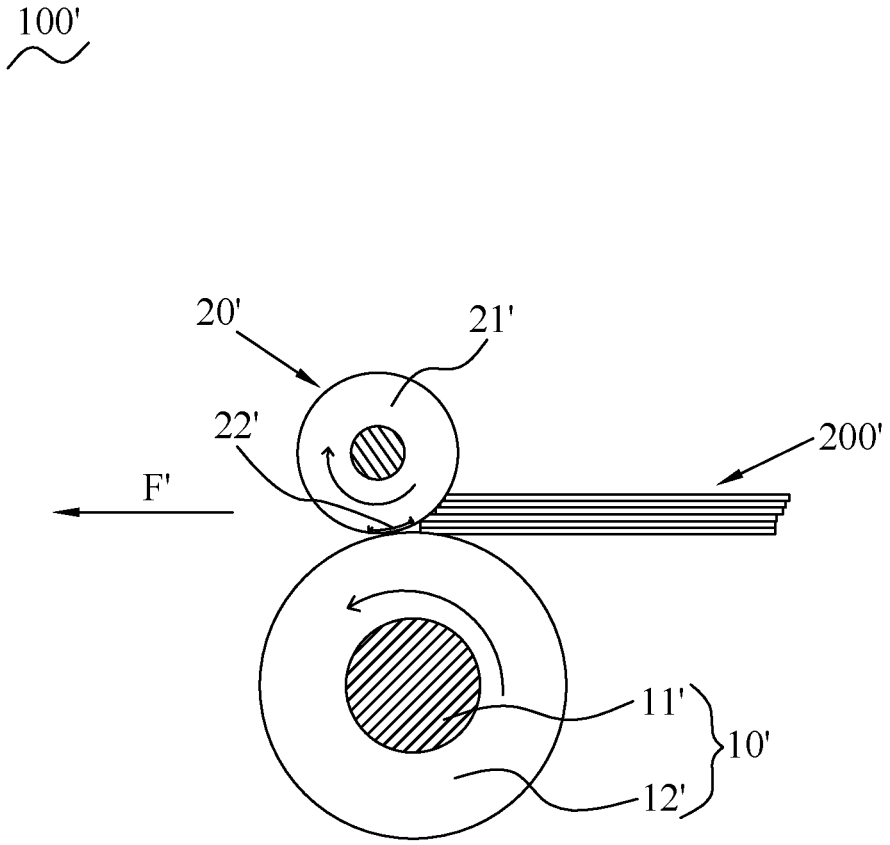
FIG. 8 (Prior Art)
FIG. 8 is a diagrammatic drawing of a conventional paper feeding device in prior art.
Figure 9:
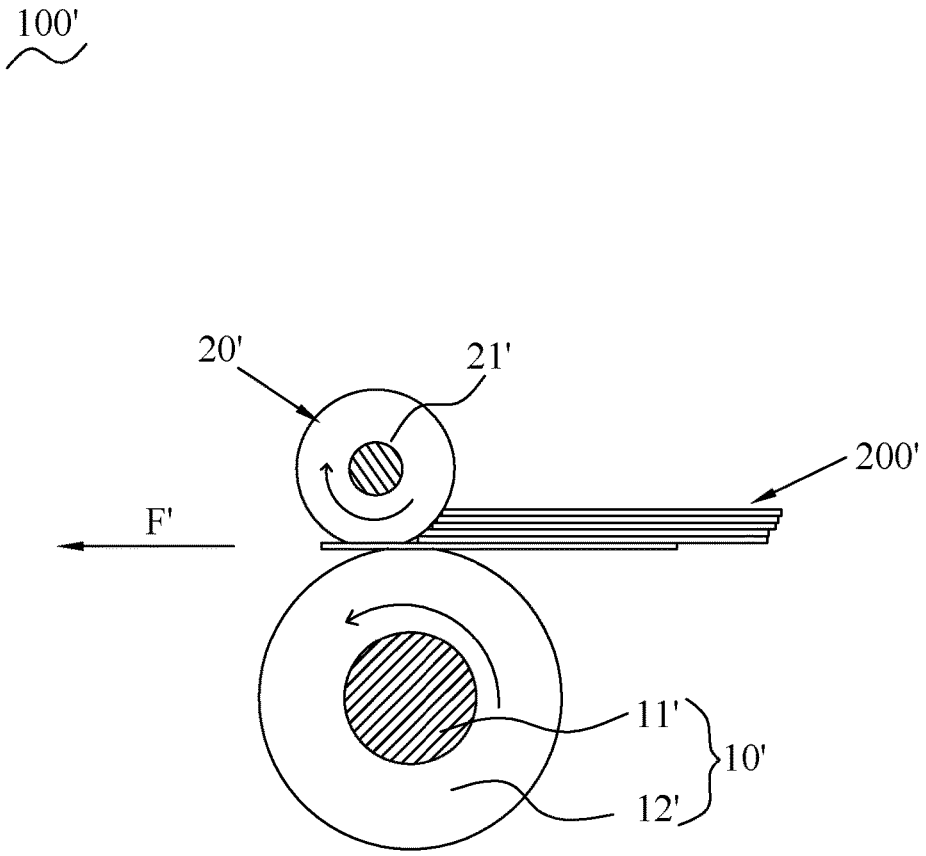
FIG. 9 (Prior Art)
FIG. 9 is a diagrammatic drawing of the conventional paper feeding device of FIG. 8, wherein the paper is fed into the conventional paper feeding device.
Figure 10:
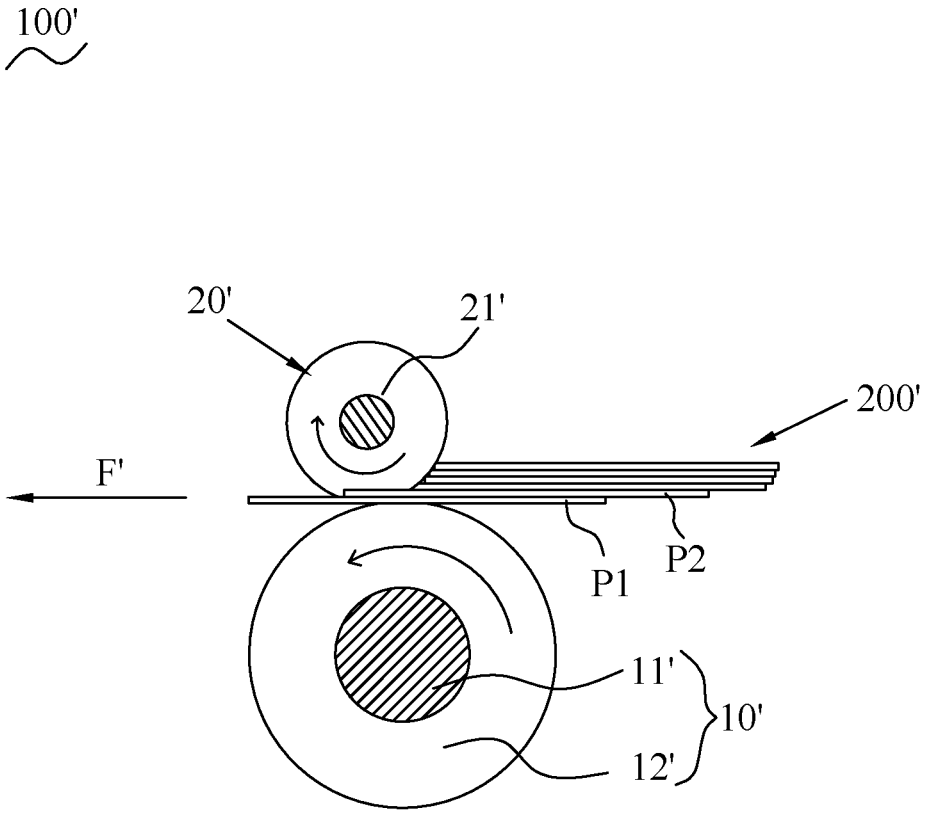
FIG. 10 (Prior Art)
FIG. 10 is a diagrammatic drawing of the conventional paper feeding device in prior art, wherein when a first paper is fed in, a second paper is driven to be fed into an area where an outer surface of a pickup roller of the conventional paper feeding device abuts against an outer surface of a separation roller of the conventional paper feeding device.

A sequence chart of the paper feeding device 100 in accordance with the first preferred embodiment of the present invention is shown in FIG. 7. The paper feeding device 100 further includes a paper position sensor 101 for detecting a position of the paper 200, a gap sensor 102 for detecting a distance between each two pieces of the paper 200, a pick sensor 103 for detecting whether the paper 200 has been picked up by the pickup roller assembly 10 or not, and a paper loading sensor 104 for detecting whether the input tray 30 loading the paper 200 or not. The paper loading sensor 104, the pick sensor 103, the gap sensor 102 and the paper position sensor 101 are arranged in sequence along the feeding direction F of the paper 200. Specifically, the paper feeding device 100 further includes the paper position sensor 101 for detecting a position of the first paper 201, the gap sensor 102 for detecting a distance between the first paper 201 and the second paper 202, the pick sensor 103 for detecting whether the first paper 201 has been picked up by the pickup roller assembly 10 or not, and the paper loading sensor 104 for detecting whether the input tray 30 loading the first paper 201 or not. The paper loading sensor 104, the pick sensor 103, the gap sensor 102 and the paper position sensor 101 are arranged in sequence along the feeding direction F of the first paper 201 and the second paper 202.

When the first transmission module 61 rotates towards the anticlockwise direction to pick up the first paper 201, a rotation speed of the first transmission module 61 is a first speed (V6), the paper loading sensor 104 detects whether the input tray 30 loads the paper 200 or not, if the paper loading sensor 104 detects the input tray 30 loads the paper 200, specifically, the paper loading sensor 104 detects whether the input tray 30 loads the first paper 201 or not, if the paper loading sensor 104 detects the input tray 30 loads the first paper 201, in a first period of time T1, the first transmission module 61 rotates faster until the rotation speed of the first transmission module 61 reaches a second speed (V1) faster than the first speed (V6), and the first transmission module 61 continues rotating at the second speed (V1) until the pick sensor 103 detects the first paper 201 has been picked up; in a second period of time T2, the first transmission module 61 rotates faster until the rotation speed of the first transmission module 61 reaches a third speed (V2) faster than the second speed (V1), and the first transmission module 61 continues rotating at the third speed (V2) until the gap sensor 102 detects the distance between each two pieces of the paper 200, and the distance between each two pieces of the paper 200 will be adjusted to be appropriate for picking up the first paper 201, specifically, the first transmission module 61 continues rotating at the third speed (V2) until the gap sensor 102 detects the distance between the first paper 201 and the second paper 202, and the distance between the first paper 201 and the second paper 202 will be adjusted to be appropriate for picking up the first paper 201; in a third period of time T3, the first transmission module 61 rotates faster until the rotation speed of the first transmission module 61 reaches a fourth speed (V3) faster than the third speed (V2), and the first transmission module 61 continues rotating at the fourth speed (V3) until the paper position sensor 101 detects the position of the first paper 201 and the first transmission module 61 stops rotating, when the tail end of the first paper 201 leaves the pick sensor 103, the first transmission module 61 rotates towards the clockwise direction, in a fourth period of time T4, the first transmission module 61 rotates towards the clockwise direction at a fifth speed (V4), then the first transmission module 61 rotates faster towards the clockwise direction until the rotation speed of the first transmission module 61 reaches a sixth speed (V5) faster than the fifth speed (V4), and the first transmission module 61 continues rotating at the sixth speed (V5) until the at least one pickup roller 12 cooperates with the at least one separation roller 21 to separate the first paper 201 from the second paper 202 and the other paper 200 and drive the first paper 201 to be continued being fed forward. When the tail end of the first paper 201 leaves the gap sensor 102, the first transmission module 61 rotates towards the anticlockwise direction to pick up a next paper 200, namely, the second paper 202. The preset time is the fourth period of time T4.

Figure 5:
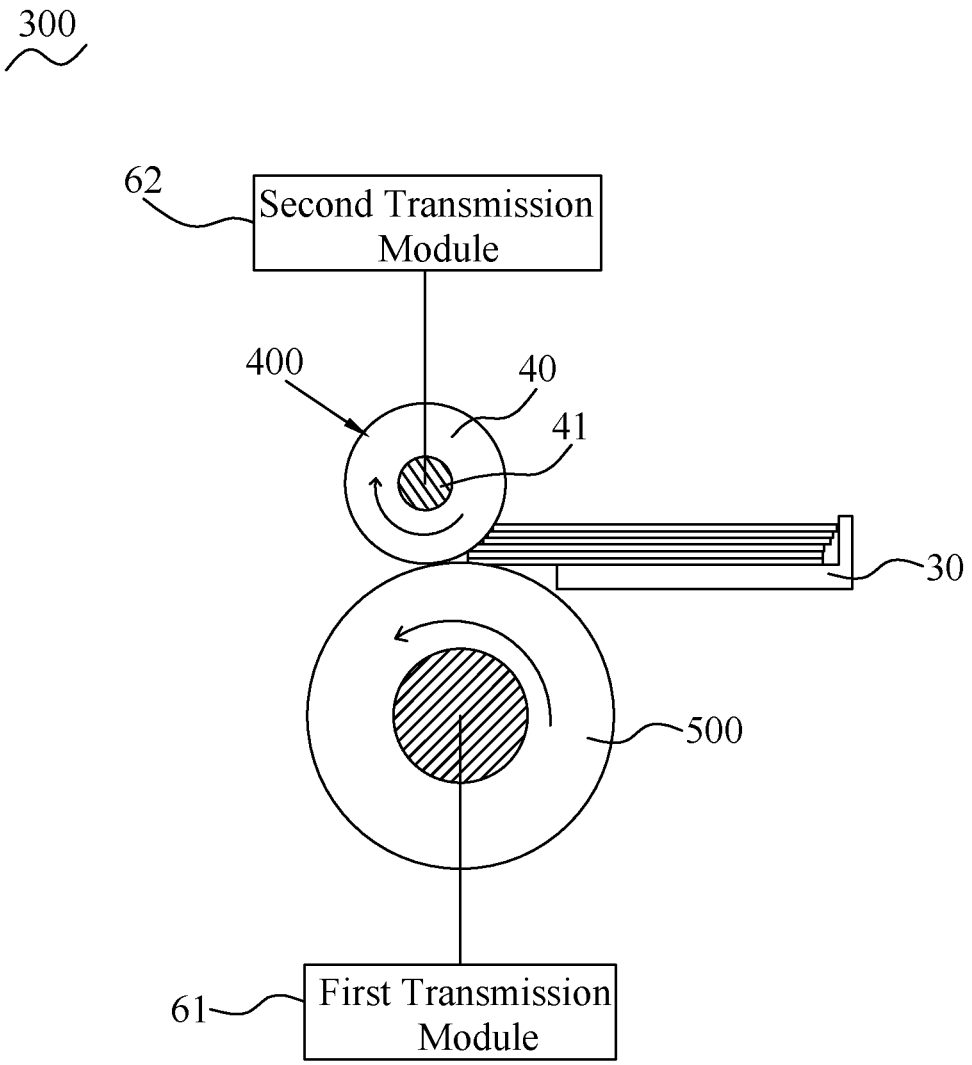
FIG. 5 is a diagrammatic drawing of a paper feeding device in accordance with a second preferred embodiment of the present invention.

Referring to FIG. 1 and FIG. 5, a paper feeding device 300 in accordance with a second preferred embodiment of the present invention is shown. Differences between the paper feeding device 100 in accordance with the first preferred embodiment and the paper feeding device 300 in accordance with the second preferred embodiment are described as follows. In the second preferred embodiment, the paper feeding device 300 further includes a second transmission module 62, at least one pickup roller 500 and a separation roller assembly 400. The separation roller assembly 400 includes a separation shaft 41 and at least one separation roller 40. The at least one separation roller 40 is fastened around the separation shaft 41. The second transmission module 62 is connected with the separation roller assembly 400 for driving the separation roller assembly 400 to rotate towards the clockwise direction or the anticlockwise direction. The second transmission module 62 is connected with the separation shaft 41, and the second transmission module 62 is capable of driving the separation shaft 41 and the at least one separation roller 40 to rotate towards the clockwise direction or the anticlockwise direction, namely, in contrast with the paper feeding device 100 in accordance with the first preferred embodiment, when the first transmission module 61 drives the at least one pickup roller 500 to rotate towards the anticlockwise direction, the second transmission module 62 drives the at least one separation roller 40 to rotate towards the clockwise direction, when the first transmission module 61 drives the at least one pickup roller 500 to rotate towards the clockwise direction, the second transmission module 62 drives the at least one separation roller 40 to rotate towards the anticlockwise direction. So the first transmission module 61 of the paper feeding device 100 in accordance with the first preferred embodiment or the paper feeding device 300 in accordance with the second preferred embodiment is capable of driving the at least one pickup roller 12 to rotate towards the clockwise direction or the anticlockwise direction, the paper feeding device 300 in accordance with the second preferred embodiment and the paper feeding device 100 in accordance with the first preferred embodiment have a same function.

As described above, the first transmission module 61 of the paper feeding device 100 in accordance with the first preferred embodiment or the paper feeding device 300 in accordance with the second preferred embodiment is capable of driving the at least one pickup roller 12 to rotate towards the clockwise direction or the anticlockwise direction by virtue of a direction limiter (not shown) being without being disposed to the pickup shaft 11, starting with the second paper 202, thereafter, before the at least one pickup roller 12 rotates towards the anticlockwise direction to proceed picking up the first paper 201 every time, the at least one pickup roller 12 is in need of rotating towards the clockwise direction at the preset time in advance, the second paper 202 and the other paper 200 brought in at the time of the previous paper 200, namely the first paper 201 being fed in is withdrawn until the second paper 202 and the other paper 200 are withdrawn from the area of the outer surface of the at least one pickup roller 12 abutting against the outer surface of the at least one separation roller 21, so that the paper feeding device 100 effectively prevents more than one piece of the paper 200 from being fed in and the damage of the paper 200.

What is claimed is:

1. A paper feeding device mounted in a transaction device for transmitting paper, comprising:

a first transmission module mounted in the transaction device;

a pickup shaft rotatably and pivotally connected to the transaction device, the pickup shaft being connected with the first transmission module, and the first transmission module being capable of driving the pickup shaft to rotate towards a clockwise direction or an anticlockwise direction;

at least one pickup roller fastened around the pickup shaft; and at least one separation roller rotatably and pivotally connected to the transaction device, an outer surface of the at least one separation roller oppositely abutting against an outer surface of the at least one pickup roller, the first transmission module driving the pickup shaft and the at least one pickup roller to rotate towards the anticlockwise direction to pick up the paper and feed forward the paper, the paper including a first paper, and a second paper adhered to a top surface of the first paper, wherein when the at least one pickup roller rotates towards the anticlockwise direction and drives the at least one separation roller to rotate towards the clockwise direction, the at least one pickup roller cooperating with the at least one separation roller to separate the first paper from the second paper and drive the first paper to be continued being fed forward, wherein when a tail end of the first paper leaves the at least one pickup roller and the at least one separation roller, the first transmission module driving the at least one pickup roller to rotate towards the clockwise direction at a preset time, and simultaneously the at least one pickup roller driving the at least one separation roller to rotate towards the anticlockwise direction at the preset time, so that the second paper brought in at the time of the first paper being fed in is withdrawn until the second paper is withdrawn from an area of the outer surface of the at least one pickup roller abutting against the outer surface of the at least one separation roller.

2. The paper feeding device as claimed in claim 1, further comprising a separation shaft, and a second transmission module connected with the separation shaft, the at least one separation roller being fastened around the separation shaft, and the second transmission module being capable of driving the separation shaft and the at least one separation roller to rotate towards the clockwise direction or the anticlockwise direction.

3. The paper feeding device as claimed in claim 1, wherein the paper further includes other paper disposed to a top surface of the second paper, when the at least one pickup roller rotates towards the anticlockwise direction and drives the at least one separation roller to rotate towards the clockwise direction, the at least one pickup roller cooperates with the at least one separation roller to separate the first paper from the second paper and the other paper.

4. The paper feeding device as claimed in claim 3, further comprising a paper position sensor for detecting a position of the paper, a gap sensor for detecting a distance between each two pieces of the paper, a pick sensor for detecting whether the paper has been picked up or not, and a paper loading sensor for detecting whether an input tray of the paper feeding device loads the paper or not.

5. The paper feeding device as claimed in claim 4, wherein the paper loading sensor, the pick sensor, the gap sensor and the paper position sensor are arranged in sequence along a feeding direction of the paper.

6. The paper feeding device as claimed in claim 4, wherein when the first transmission module rotates towards the anticlockwise direction to pick up the first paper, a rotation speed of the first transmission module is a first speed, the paper loading sensor detects whether the input tray loads the paper or not, if the paper loading sensor detects the input tray loads the paper, in a first period of time, the first transmission module rotates faster until the rotation speed of the first transmission module reaches a second speed faster than the first speed, and the first transmission module continues rotating at the second speed until the pick sensor detects the first paper has been picked up.

7. The paper feeding device as claimed in claim 6, wherein in a second period of time, the first transmission module rotates faster until the rotation speed of the first transmission module reaches a third speed faster than the second speed, and the first transmission module continues rotating at the third speed until the gap sensor detects the distance between each two pieces of the paper, and the distance between each two pieces of the paper will be adjusted to be appropriate for picking up the first paper.

8. The paper feeding device as claimed in claim 7, wherein in a third period of time, the first transmission module rotates faster until the rotation speed of the first transmission module reaches a fourth speed faster than the third speed, and the first transmission module continues rotating at the fourth speed until the paper position sensor detects the position of the first paper and the first transmission module stops rotating, when the tail end of the first paper leaves the pick sensor, the first transmission module rotates towards the clockwise direction.

9. The paper feeding device as claimed in claim 8, wherein in a fourth period of time, the first transmission module rotates towards the clockwise direction at a fifth speed, then the first transmission module rotates faster towards the clockwise direction until a rotation speed of the first transmission module reaches a sixth speed faster than the fifth speed, and the first transmission module continues rotating at the sixth speed until the at least one pickup roller cooperates with the at least one separation roller to separate the first paper from the second paper and the other paper and drive the first paper to be continued being fed forward, when the tail end of the first paper leaves the gap sensor, the first transmission module rotates towards the anticlockwise direction to pick up the second paper.

10. The paper feeding device as claimed in claim 9, wherein the preset time is the fourth period of time.

11. The paper feeding device as claimed in claim 1, further comprising a paper position sensor for detecting a position of the first paper, a gap sensor for detecting a distance between the first paper and the second paper, a pick sensor for detecting whether the first paper has been picked up or not, and a paper loading sensor for detecting whether an input tray of the paper feeding device loads the first paper or not.

12. The paper feeding device as claimed in claim 11, wherein the paper loading sensor, the pick sensor, the gap sensor and the paper position sensor are arranged in sequence along a feeding direction of the first paper and the second paper.

13. The paper feeding device as claimed in claim 11, wherein when the first transmission module rotates towards the anticlockwise direction to pick up the first paper, a rotation speed of the first transmission module is a first speed, the paper loading sensor detects whether the input tray loads the first paper or not, if the paper loading sensor detects the input tray loads the first paper, in a first period of time, the first transmission module rotates faster until the rotation speed of the first transmission module reaches a second speed faster than the first speed, and the first transmission module continues rotating at the second speed until the pick sensor detects the first paper has been picked up.

14. The paper feeding device as claimed in claim 13, wherein in a second period of time, the first transmission module rotates faster until the rotation speed of the first transmission module reaches a third speed faster than the second speed, and the first transmission module continues rotating at the third speed until the gap sensor detects the distance between the first paper and the second paper, and the distance between the first paper and the second paper will be adjusted to be appropriate for picking up the first paper.

15. The paper feeding device as claimed in claim 14, wherein in a third period of time, the first transmission module rotates faster until the rotation speed of the first transmission module reaches a fourth speed faster than the third speed, and the first transmission module continues rotating at the fourth speed until the paper position sensor detects the position of the first paper and the first transmission module stops rotating, when the tail end of the first paper leaves the pick sensor, the first transmission module rotates towards the clockwise direction.

16. The paper feeding device as claimed in claim 15, wherein in a fourth period of time, the first transmission module rotates towards the clockwise direction at a fifth speed, then the first transmission module rotates faster towards the clockwise direction until the rotation speed of the first transmission module reaches a sixth speed faster than the fifth speed, and the first transmission module continues rotating at the sixth speed until the at least one pickup roller cooperates with the at least one separation roller to separate the first paper from the second paper and drive the first paper to be continued being fed forward, when the tail end of the first paper leaves the gap sensor, the first transmission module rotates towards the anticlockwise direction to pick up the second paper.

* * * * *